US006428003B1

(12) United States Patent
Fondin et al.

(10) Patent No.: US 6,428,003 B1
(45) Date of Patent: Aug. 6, 2002

(54) APPARATUS AND METHOD OF PLAYING A STRATEGY GAME

(76) Inventors: Gilles Fondin, 32 rue Félix Thomas, 44000 Nantes (FR); Cyrille Guillot, No. 1, Flat C, 1st. Floor, Sea Horse Lane, Discovery Bay, Lantau Island, Hong Kong (HK)

( * ) Notice: Subject to any disclaimer, the term of this patent is extended or adjusted under 35 U.S.C. 154(b) by 0 days.

(21) Appl. No.: 09/700,341

(22) PCT Filed: Dec. 27, 1999

(86) PCT No.: PCT/FR99/03293

§ 371 (c)(1),
(2), (4) Date: Mar. 27, 2001

(87) PCT Pub. No.: WO00/38804

PCT Pub. Date: Jul. 6, 2000

(30) Foreign Application Priority Data

Dec. 29, 1998 (FR) ..... 9816697

(51) Int. Cl.[7] ..... A63F 3/00

(52) U.S. Cl. ..... 273/241; 273/271; 273/280; 273/287

(58) Field of Search ..... 273/241, 271, 273/280, 287, 309, 265, 138.3, 138.4, 144 R, 144 A, 144 B; 463/69

(56) References Cited

U.S. PATENT DOCUMENTS 3,610,620 A * 10/1971 Stein
4,022,473 A * 5/1977 Foley
4,243,227 A * 1/1981 Strongin
4,552,362 A * 11/1985 Oakd
4,582,326 A 4/1986 Alsip
4,979,748 A 12/1990 Danielak et al.

FOREIGN PATENT DOCUMENTS

| | | |
|---|---|---|
| FR | 2661839 | * 11/1991 |
| GB | 210097 | 6/1983 |
| GB | 2137891 | 10/1984 |
| WO | 00/38804 | 7/2000 |

* cited by examiner

*Primary Examiner*—Benjamin H. Layno
(74) *Attorney, Agent, or Firm*—Greenblum & Bernstein, P.L.C.

(57) ABSTRACT

Strategy game using at least two lots of game pieces with each lot being allocated to a player. The game includes a game grid forming rows and columns, and having a juxtaposition of parallel chutes. The parallel chutes include a first end and a second end. At least one of the first and second ends is adapted to receive the game pieces. At least one of the first and second ends is adapted to be blocked so as to prevent the game pieces from falling out. The game grid is movable between at least a position wherein a first end is substantially disposed above the second end and at least a position wherein a second end is substantially disposed above the first end. The game pieces are visible when disposed within the game grid.

35 Claims, 6 Drawing Sheets

APPARATUS AND METHOD OF PLAYING A STRATEGY GAME

CROSS-REFERENCE TO RELATED APPLICATIONS

The present application is a National Stage Application of International Application No. PCT/FR99/03293, filed Dec. 27, 1999. Further, the present application claims priority under 35 U.S.C. §119 of French Patent Application No. 98/16697 filed on Dec. 29, 1998.

BACKGROUND OF THE INVENTION

1. Field of the Invention

In certain corresponding structures currently available on the market, the game grid has the shape of a relatively flat parallelepiped. This grid consists of two parallel plane faces connected by walls that delineate the juxtaposed chutes. Both parallel plane faces comprise circular openings in order to is visualise the game pieces piled up in the chutes.

This invention relates to the general domain of strategy games; and concerns in particular a strategy game for at least two players, utilizing game pieces, a game grid, and a plurality of juxtaposed vertical chutes in which the game pieces can be piled up in order to form rows and columns.

2. Discussion of Background Information

In games of this type, the players take turn positioning a game piece in the vertical grid, with a view to form a row of a number of one's own pieces, horizontally, vertically or diagonally.

The game grid is carried by an underframe that maintains the grid in a vertical plane. The juxtaposed chutes are open in the upper part to enable insertion of the game pieces; a removable bottom enables to keep the pieces and to dispose of them downwards once the game is completed.

SUMMARY OF THE INVENTION

This invention suggests to perfect the games that implement game pieces and a grid composed of a plurality of parallel chutes, in order to increase the strategic opportunities and consequently, to render the invention more attractive.

According to this invention, the game comprises a mechanism for turning the game grid upside down so as to reverse the position of its top and bottom edges, and the grid comprises a mechanism enabling both ends of the juxtaposed chutes to be removably blocked.

This structure enables the players to take turns inserting a game piece in the chutes of the reception grid, so as to try and form a predetermined geometric figure (straight line, cross; arrow . . . ), predefined using one's own pieces.

During the game and according to a pre-set rule, the players may decide to turn the grid upside down in order to modify the positioning of the game pieces, according to one's own strategy or to disturb the opponent's strategy.

To perform this operation, the upper end of the chutes is closed by the blocking mechanism provided on the corresponding edge of the game grid, the grid is turned upside down, then the blocking mechanism that formed the bottom of the chutes previously and are now located in the upper section, are deactivated, so that new game pieces can be inserted via the upper end of the chutes.

The game grid can be mounted as fixed on its support frame; in which case, it is the frame/grid assembly that can be turned upside down, whereas the frame has an appropriate structure to ensure stable positioning of the grid, vertically, in one direction or the other.

According to another possible embodiment, the game grid is articulated on its support frame about a horizontal axis so that it can be turned upside down by pivoting at 180°; the grid also comprises a mechanism for locking it in vertical position on the support frame.

According to one aspect of the invention, there is provided a strategy game using at least two lots of game pieces with each lot being allocated to a player, the game comprising a game grid forming rows and columns, and having a juxtaposition of parallel chutes, the parallel chutes including a first end and a second end, at least one of the first and second ends being adapted to receive the game pieces, at least one of the first and second ends being adapted to be blocked so as to prevent the game pieces from falling out, the game grid being movable between at least a position wherein a first end is substantially disposed above the second end and at least a position wherein a second end is substantially disposed above the first end, wherein the game pieces are visible when disposed within the game grid.

The game grid may comprise at least two ends which are adapted to receive the game pieces. The game grid may comprise at least two ends which are adapted to be blocked. Each of the first and second ends of parallel chutes may be adapted to receive the game pieces. Each of the first and second ends of the parallel chutes may be adapted to be blocked. The game grid is configureable so that the first end of parallel chutes receive the game pieces, while the second end of the parallel chutes is blocked. The game grid may be configureable so that the second end of parallel chutes receive the game pieces, while the first end of the parallel chutes is blocked. The game grid may be adapted to be arranged in a vertical or substantially vertical plane. The game may further comprise a frame for supporting the game grid. The game grid may be rotatably mounted to the frame. The game may further comprise at least one blocking mechanism for blocking one of the first and second ends in order to prevent the game pieces from falling out. The at least one blocking mechanism may comprise first and second blocking mechanisms for blocking the respective first and second ends. The at least one blocking mechanism may be movable between a blocking position which prevents the game pieces from falling out and an un-blocking position which allows the game pieces to fall out. The game grid may be one of pivotally and rotatably mounted on the frame about a horizontal axis. The game grid may be rotatable or pivotal by 180°.

The game grid may be adapted to be locked in at least one position. The game grid may be adapted to be locked in two positions. The game may further comprise a mechanism for locking the game grid with respect to the frame. The frame may comprise two vertical stanchions and each stanchion may be arranged to be disposed along a side the game grid. The game may further comprise an articulation disposed between each stanchion and side of the game grid. Each side of the game grid may be pivotally mounted to a corresponding stanchion. At least one of the stanchions may comprise a mechanism adapted to cooperate with a mechanism disposed on the game grid, the mechanisms being adapted to lock the game grid in a vertical position. The mechanism disposed on the game grid may comprise at least one protruding toe. The mechanism disposed on the stanchion may comprise one of a snap-on system and a groove having contraction zones. Each side of the game grid may comprise at least one protruding toe. Each of the stanchions may comprise one of a snap-on system and a groove having contraction zones adapted to engage a corresponding protruding toe. The game may further comprise at least one blocking mechanism for blocking one of the first and second ends in order to prevent the game pieces from failing out, the at least one blocking mechanism being disposed adjacent an edge of the first or second ends. The blocking mechanism may comprise a retention element adapted to slide in an internal groove of the game grid. The retention element may comprise a control cursor which is adapted to be moved between at least a closed position and an opened position.

The control cursor may be accessible by a player in order to move the retention element. The at least one blocking mechanism may be slidably disposed within the game grid and the at least one blocking mechanism may comprise at least one cursor, a plurality of openings, and a plurality of rungs. The at least one blocking mechanism may be slidably disposed within the game grid and the at least one blocking mechanism may comprise at least one cursor and a flexible rod. The game grid may further comprise at least one blocking mechanism and at least one protruding toe, and the toe may be movably connected to a cursor. The game may further comprise a frame with two vertical stanchions, wherein the game grid is configured such that movement of the cursor also controls movement of the at least one blocking mechanism, and such that the toe co-operates with a stop disposed on a vertical stanchion of a frame for locking the game grid in a vertical position.

The invention also provides for a method of playing a game comprising at least two lots of game pieces, each lot being allocated to a player, a game grid forming rows and columns, and having a juxtaposition of parallel chutes, the parallel chutes having a first end and a second end, at least one of the first and second ends being adapted to receive the game pieces, at least one of the first and second ends being adapted to be blocked so as to prevent the game pieces from falling out, the game grid being movable between at least a position wherein a first end is substantially disposed above the second end and at least a position wherein a second end is substantially disposed above the first end, wherein the game pieces are visible when disposed within the game grid. The method comprises placing the game pieces in the game grid, moving the game grid to a first substantially vertical position wherein the first end is disposed above the second end, moving the game grid to a second substantially vertical position wherein the second end is disposed above the first end, and blocking at least one of the first and the second end.

BRIEF DESCRIPTION OF THE DRAWINGS

Other characteristics will appear in the light of the following description of various embodiments, given solely for exemplification purposes and represented on the appended drawings, in which.

DETAILED DESCRIPTION OF THE INVENTION

Figure 1:
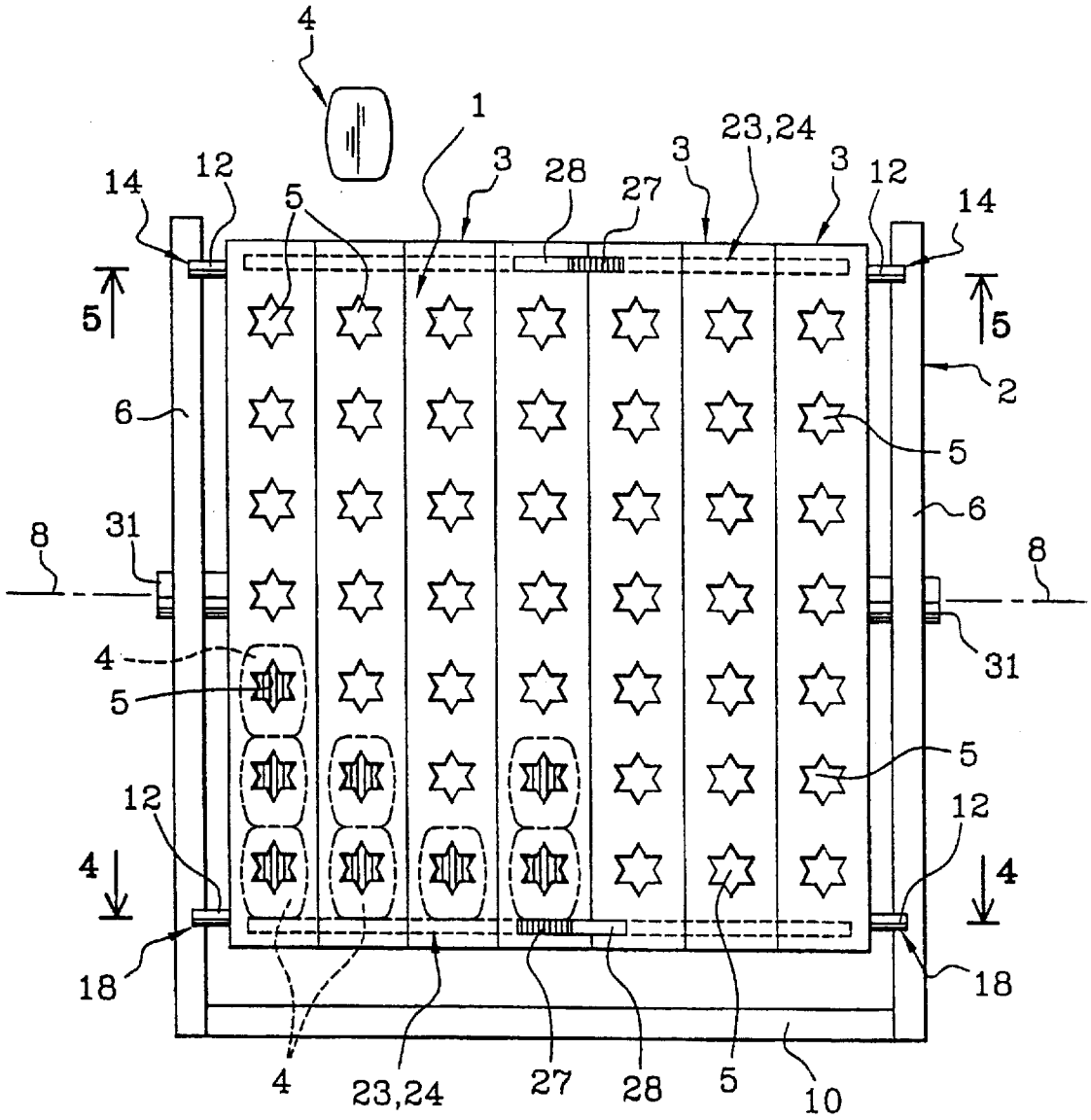
FIG. 1 is a front view of a first possible embodiment of the strategy game according to the invention.
Figure 2:
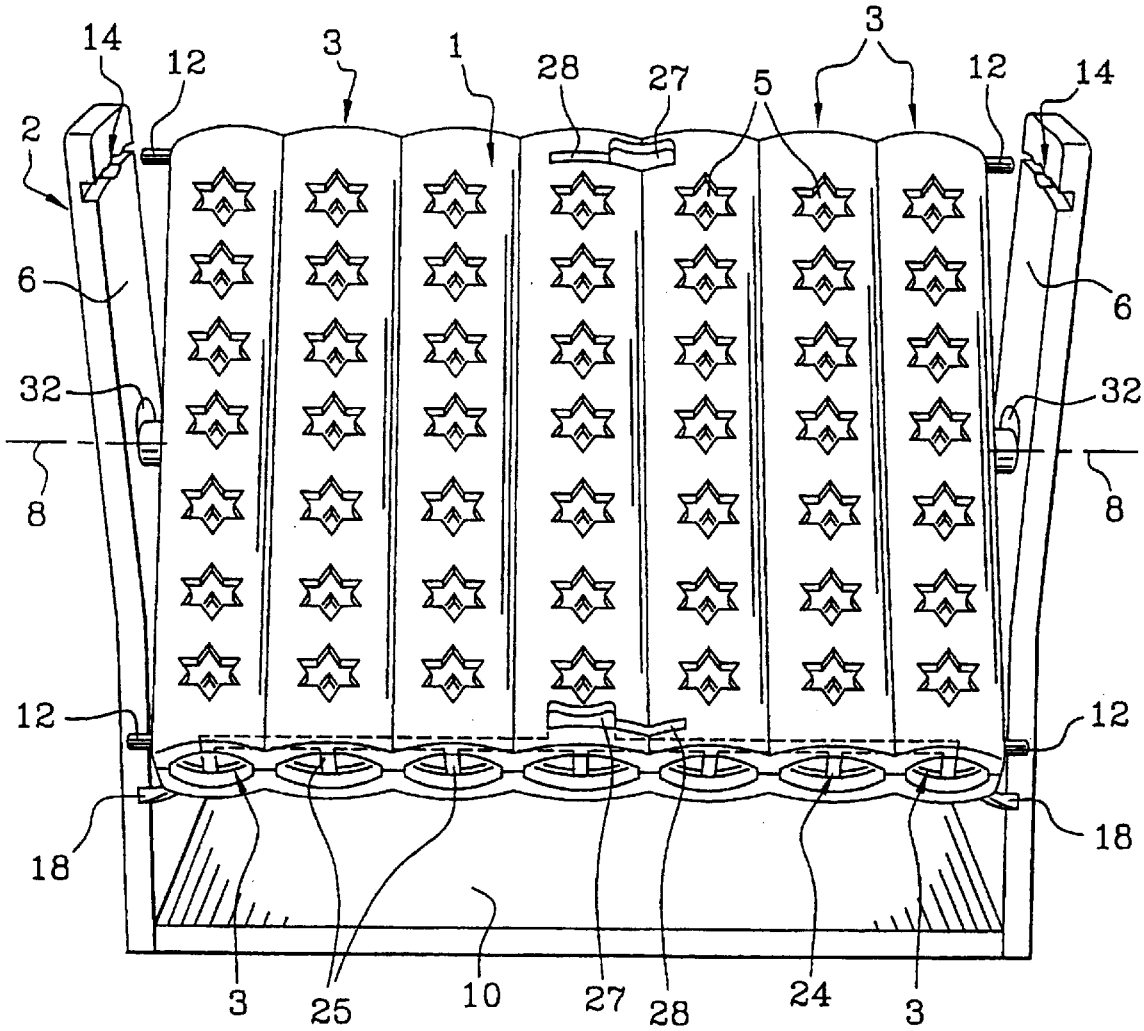
FIG. 2 shows the same game, seen in perspective, when turning the game grid upside down.

As can be seen in the embodiment of FIGS. 1 and 2, the game according to this invention comprises a game grid 1 carried by a support frame 2. The game grid 1 utilizes a juxtaposition of vertical chutes 3 in which game pieces 4 can be piled up so as to form rows and columns of pieces.

In such a case, the game grid 1 utilizes seven chutes, whereas in each of them, seven game pieces can be piled up. A lot of game pieces is allocated to each player and the pieces of each lot can be differentiated for instance by their color.

The different game pieces 4 piled up in the chutes 3 are visible via windows 5 provided on either side of the grid 1. These windows have the shape of a star, but they can adopt any other shape, according to the overall aesthetic desired.

The game grid 1 is generally square or rectangular in shape according to the number of chutes 3 and according to the height of the chutes; e.g., the game grip can comprise two lateral vertical sides and two horizontal end edges.

The game grid 1 is articulated on the vertical stanchions 6 of the frame 2 about a rotation axis 8 so that the grid can be turned upside down.

The rotation axis 8 is situated in the middle section of the grid 1 for easier pivoting. Both vertical stanchions 6 of the frame 2 extend in height slightly above the upper level of the game grid; at the lower section, they are interconnected by a linking structure 10 in the form of a footing.

The game grid 1 comprises lateral toes 12 arranged on the cants of its lateral sides, that enable to lock it removably in vertical position, in connection with a snap-on system 14 provided on the stanchions 6. The toes 12 look like protruding journals, four in number, provided at the ends of each lateral cant of the grid.

Figure 3:
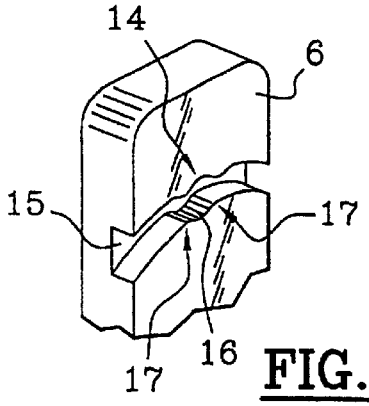
FIG. 3 is a detailed view, in perspective, showing the upper end of the vertical stanchions that support the game grid, with the snap-on system that enables to lock the grid in vertical position.

A snap-on system 14, detailed on FIG. 3, is provided in the upper section of each stanchion 6; this snap-on system has the shape of a groove 15 provided in the internal face of the stanchion 6, fitted with a recess for central positioning 16 flanked, on either side, by two contraction zones 17.

The toes 12 located at the upper end edge of the game grid will nest slightly and forcibly into the central recess 16 of the lateral snap-on systems 14, for stable positioning of the grid during the game. The grid can also be disengaged using a little strength so as to be turned upside down.

Every snap-on system 14 is symmetrical on either side of the central recess 16 so that the locking and releasing operations can be performed on one side or the other, indifferently.

The toes 12 situated at the lower edge of the game grid are used for locking this grid in the upper snap-on systems 14, after pivoting at 180°. In the lower section of the internal face of the stanchions 6, there are grooves 18 through which the lateral lugs 12, located at the lower end edge of the game grid, pass unimpeded.

The game grid 1 also comprises a mechanism for blocking or opening the ends of the chutes 3, controlled in relation to the position of the chutes. The blocking position is used in the lower section of the grid, to form the bottom of the chutes; the opening position is used in the upper section of the grid to enable insertion of the game pieces in the chutes.

Figure 4:
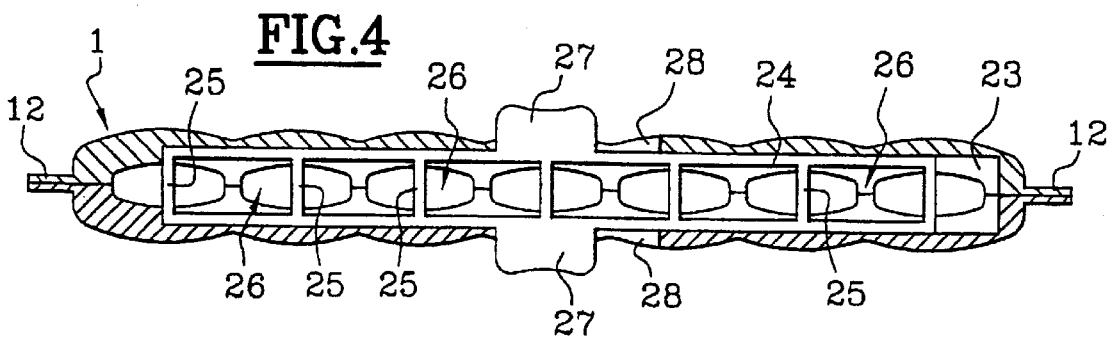
FIG. 4 is a cross sectional view along line 4—4 of FIG. 1, showing the removable blocking system at the end of the chutes, in active position.
Figure 5:
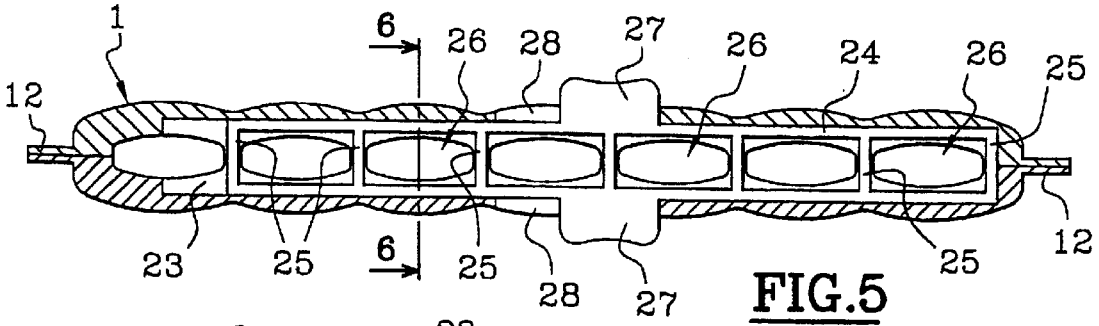
FIG. 5 is a cross sectional view along line 5—5 of FIG. 1, showing the removable blocking system at the end of the chutes, in inactive position.
Figure 6:
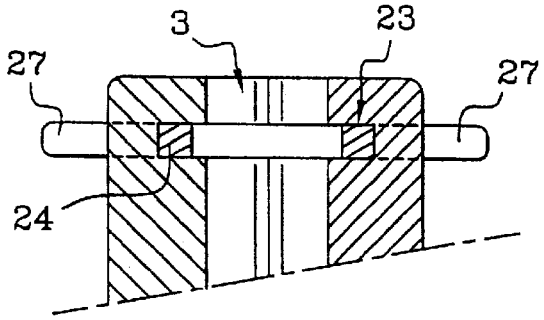
FIG. 6 is a cross sectional view along line 6—6 of FIG. 5.

These mechanisms, on each end edge of the game grid are detailed in FIGS. 4 to 6. They utilize an internal groove 23 provided in the structure of the grid 1 parallel to its end edges, in which a retention element 24 is positioned. This retention element 24 has the general shape of a flat ladder whose width corresponds to that of the groove 23, within the clearance, and whose length is smaller for easier sliding motion. The rungs 25 of the ladder 24 form blocking members separated by openings 26.

The number of rungs 25 corresponds to the number of chutes 3 and the retention element 24 may slide over half a chute's width, so as to adopt:—a closing position (FIG. 4) in which the blocking rungs 25 are placed in front of the end of the chutes 3, and—an opening position (FIG. 5) in which the openings 26 are placed in front of the end of the chutes 3, whereby the rungs 25 are laid on their side.

The retention elements 24 are controlled using single-block lateral extensions 27 that extend on either side of the grid 1 through oblong slots 28; these lateral extensions 27 make up a control cursor.

The game grid 1 utilizes two identical semi-shells, molded in plastic, whose internal faces are structured so as to form a portion of the parallel chutes 3 and a portion of the grooves 23 intended for positioning the retention elements 24. Both these semi-shells are assembled together, after positioning the retention elements 24 in their reception groove 23.

Figure 7:
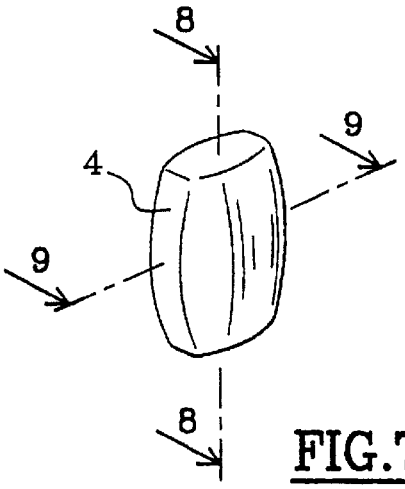
FIG. 7 is a perspective view of one of the game pieces.
Figure 8:
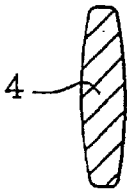
FIG. 8 is a cross sectional view along line 8—8 of FIG. 7.
Figure 9:
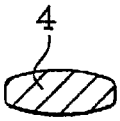
FIG. 9 is a cross sectional view along line 9—9 of FIG. 7.

On the embodiment illustrated on the drawings, the chutes 3 have an oblong cross section. The game pieces 4, one of whose is detailed on FIGS. 7 to 9, have a general shape and especially an adapted cross section.

Preferably, the footing 10 and both lateral stanchions 6 are realised independent from one another by plastic moulding, then assembled using appropriate nesting structures.

Figure 10:
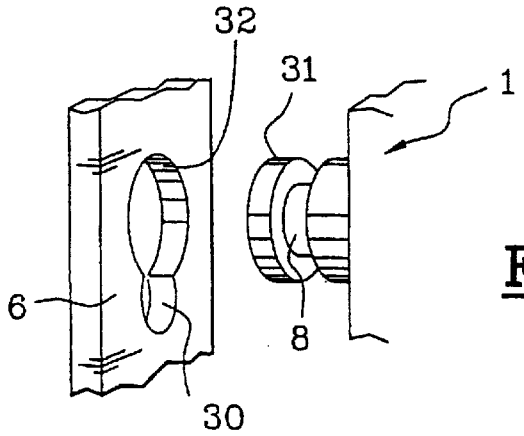
FIG. 10 is a partial perspective view that illustrates the assembly of the game grid on the vertical stanchions of the frame.

Still preferably, the game grid 1 is interconnected with the lateral stanchions 6 removably. As represented in FIG. 10, the axis portions 8 can be positioned in their support cradle 30, after passing the end flange 31 through the circular opening 32 provided in the extension of the cradle.

As illustrated in the figures, the footing 10 that links both vertical stanchions 6 may utilize a single plane plate. In an embodiment variation, the upper face of this plate may comprise recesses for accommodating game pieces; still according to another embodiment, this footing may provide a semi-cylinder arranged under the game grid 1 and whose opening is oriented upwards to form a chute for accommodating game pieces 4.

Before beginning the game, the grid 1 is locked vertically on its support frame 2; the blocking mechanism or system 23, 24 of its lower edge is actuated so as to form the bottom of the chutes 3. The blocking system 23, 24 of its upper edge is deactivated to enable insertion of the game pieces 4. The players take turns inserting a game piece 4 in the vertical chutes 3, so as to try and form a predetermined geometric figure predefined, for example a straight line made of a certain number of pieces, e.g., a cross, a star, an arrow, etc. For increased attraction of the game, according to pre-set rules, the players may decide to turn the grid upside down in order to modify the respective positioning of the game pieces 4, either according to their own strategies or to disturb the opponent's strategy, or both at the same time; the possibility of turning the grid upside down every round or every other round can be agreed in advance. To enable this pivoting, the blocking system 23, 24 arranged at the upper end edge of the game grid is actuated; the grid is pivoted about its horizontal rotation axis 8 and, after having locked the lugs 12 in the snap-on system 14, the blocking system 23, 24 is deactivated and is now placed at the upper end edge of the grid that formed previously the bottom of the chutes 3, with a view to enable new insertions of game pieces 4.

The game is ended when the predefined figure(s) has (have) been completed by one of the players or according to a predefined different rule.

It should be noted that this game can be played by more than just two people, whereas the number of different game pieces will be suited consequently.

In an embodiment variation, the blocking system 23, 24 can be adapted so as to contribute to locking the grid 1 in a vertical position. To this end, one of the ends of the retention elements 24 may comprise an extension in the form of a toe going through an opening provided on the side of the game grid and capable of nesting into a recess provided opposite, in the internal face of the corresponding lateral stanchion, when the retention elements are controlled to open the upper end of the chutes 3.

Another embodiment of the strategy game according to this invention is illustrated in FIGS. 11 to 14; in these figures, the sections identical to the previous embodiment maintain the same reference numbers for easier understanding.

In this variation, the removable blocking mechanism of the ends of the chutes 3 comprise flexible rods 35 that slide inside internal grooves 36.

A rod 35 is associated with each end edge of the game grid: the groove 36 that is guiding it, extends over practically the whole length of the corresponding end edge and practically over the whole length of one of the lateral sides of the grid.

The length of the rods 35 corresponds approximately to the length of the end edge that it may block, and each rod 35 is controlled by a cursor 37. The cursors 37 are arranged each on one of the lateral sides of the game grid; they extend on either side of the grid through longitudinal slots 38. These longitudinal slots 38 are provided along the lateral sides of the game grid; their ends delineate the travel of the blocking rods 35.

Blocking one of the ends of the chutes, using one of the flexible rods 35 is made by causing the associated cursor 37 to slide towards the corresponding end edge of the game grid. The flexible rod 35 moves on one of the angles of this grid until it blocks the ends of all the juxtaposed chutes 3. This active blocking position is visible on the lower edge of the game grid of FIG. 11.

Closing is made by a reverse motion, enabling the flexible rod 35 to be removed completely and to be placed parallel to the lateral side of the game grid. This deactivated position is visible on the upper edge of the game grid of the FIG. 11.

Figure 14:
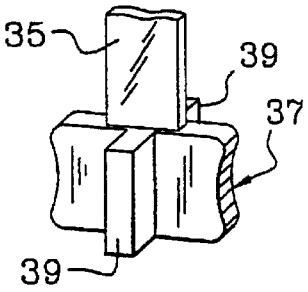
FIG. 14 is a perspective view of the cursor and of a portion of the flexible blocking rod, provided as a single bloc.

As can be seen on FIG. 14, the flexible rods 35 and the associated cursor 37 are made of single blocks, by plastic moulding.

Figure 13:
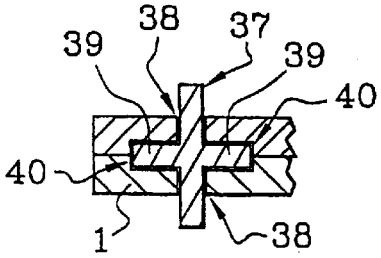
FIG. 13 is a cross sectional view along line 13—13 of FIG. 11.

As with the previous embodiment, the game grid 1 utilizes two semi-shells assembled after positioning the flexible rods 35 and their cursor 37. It can be seen in FIGS. 13 and 14 that the cursors 37 comprise two lateral wings 39 to maintain and guide the cursors 37 in appropriate grooves 40 provided along the longitudinal slots 38 (FIG. 13).

For easier displacement of the flexible rods 35 on the corresponding angles of the game grid, the curving radius of the groove 36 at that level might be increased. In such a case, the locations of the game pieces located on the corresponding angles can be deleted.

Using the game grid and/or turning the game grid upside down is identical to the procedures described in relation to the embodiment of FIGS. 1 to 10.

Figure 11:
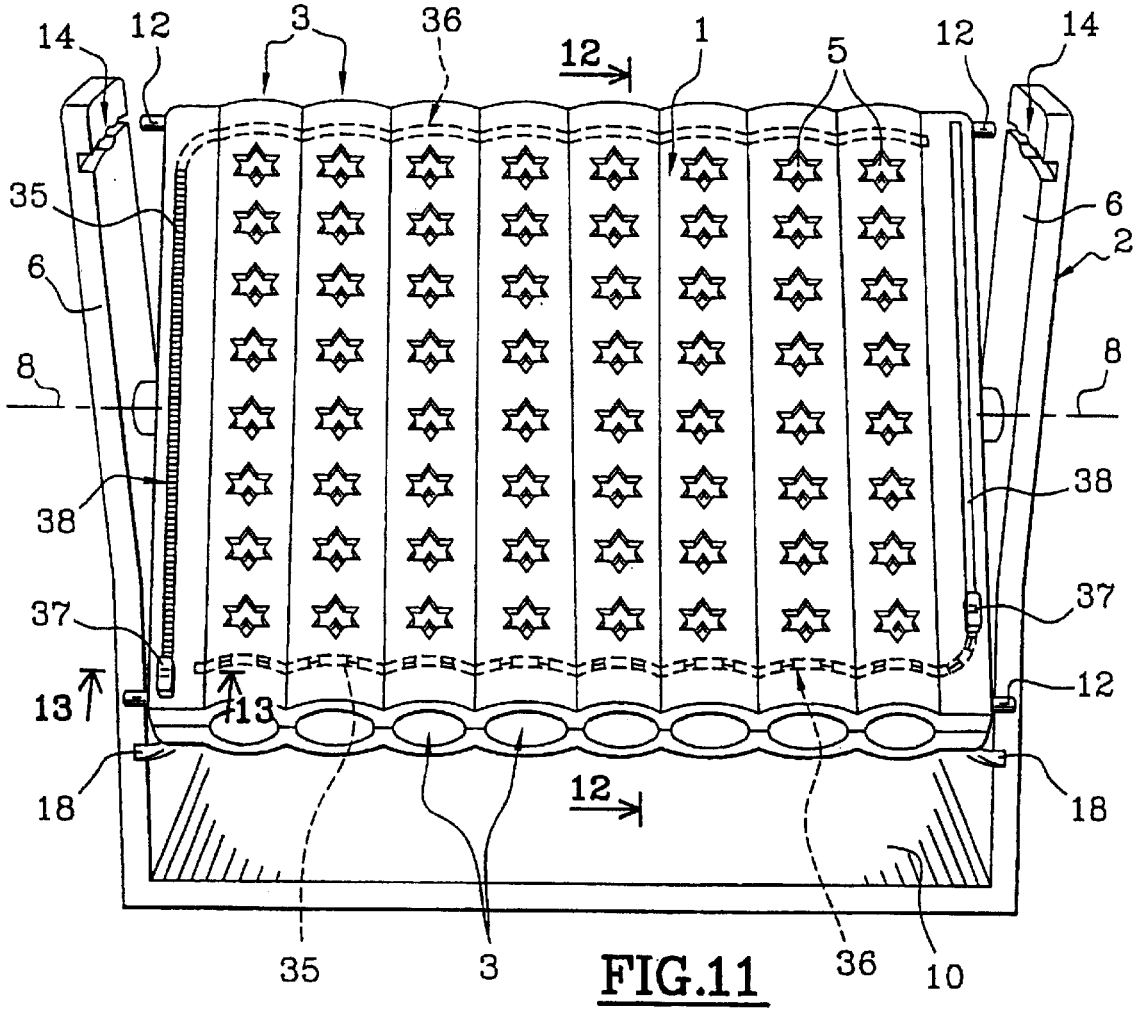
FIG. 11 is a perspective view of an embodiment variation of the strategy according to this invention.
Figure 12:
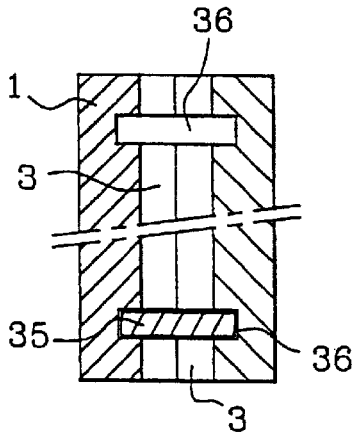
FIG. 12 is an enlarged cross sectional view along line 12—12 of FIG. 11.

In the embodiment illustrated in FIG. 11, the game grid comprises eight juxtaposed chutes 3 in which eight game pieces can be piled up. For the reasons exposed above, certain angle locations could be deleted for easier travel of the blocking rods 35; preferably, in such a case, the four angle locations will be deleted so as to obtain a homogeneous game grid.

Figure 15:
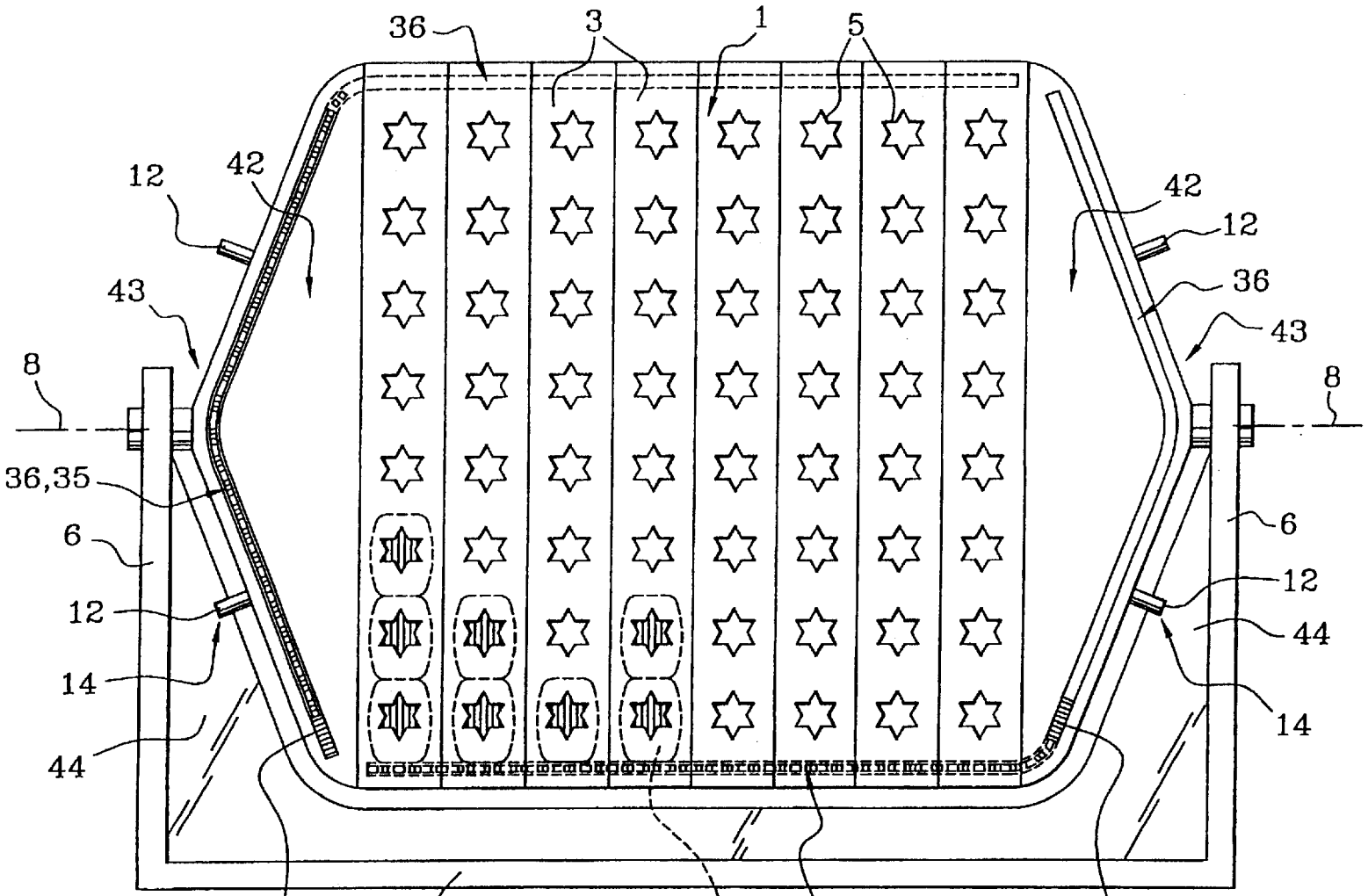
FIG. 15 is a front view of another embodiment variation of the strategy game according to this invention.

In another embodiment illustrated in FIG. 15, the game grid 1 comprises triangular lateral extensions 42 that confer it an overall hexagonal shape. The articulation 8 of the grid 1 on the lateral stanchions 6 is made at the tip 43 of the extensions 42, similarly to the nesting structure illustrated in FIG. 10 or a similar embodiment.

The mechanism for blocking the grid in vertical position is similar to those of both previous embodiments, i.e., it utilizes toes 12 integral with the game grid, that can be nested into lateral snap-on systems 14.

In this embodiment, however, the toes 12 are placed on the sides of the 75 triangular extensions 42 and the lateral snap-on systems 14 are provided below the articulation axis 8, on the edge of a structure 44 located in the alignment of the stanchions 6 or of the footing 10.

In a variation, the toes 12 can be deleted and the edge of the sides of the triangular extensions 42 can nest into a protruding snap-on structure on the extensions 44.

The removable blocking mechanism of the ends of the chutes 3 utilize two flexible rods 35 that are provided in sliding grooves 36 and that are associated with control cursors 37, in a way similar to the embodiment of FIGS. 11 to 14.

Here, however, the flexible rods 35 follow the contour of the triangular extensions 42 so as to lengthen their possible travel.

The principle of use of this embodiment is identical to that of the embodiment illustrated in FIGS. 11 to 14.

Figure 16:
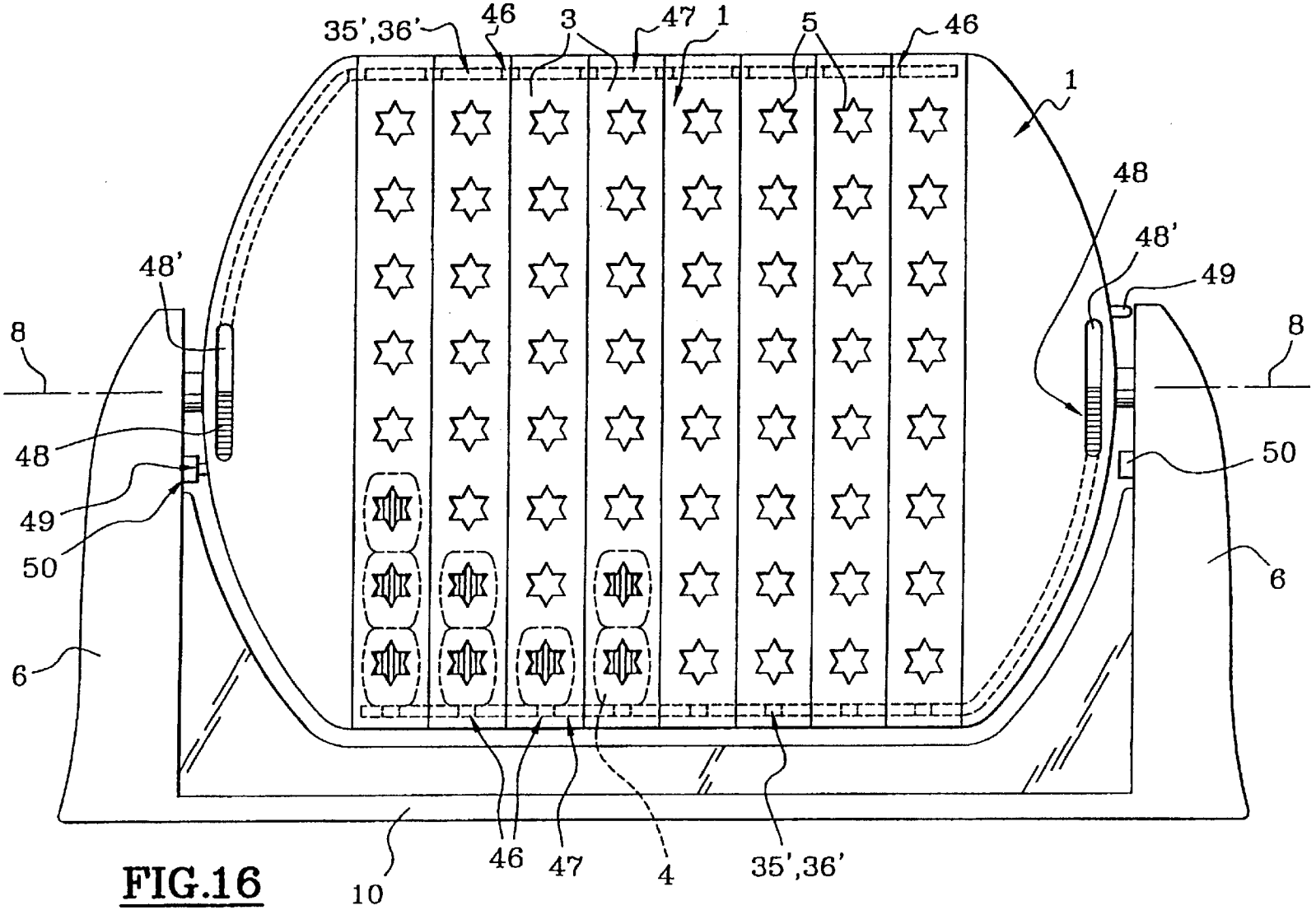
FIG. 16 is another front view of an embodiment variation of the strategy game according to this invention.

FIG. 16 illustrates a variation derived from the various previous embodiments.

In this variation, the flexible rods 35' that slide in the grooves 36' look like flat ladders with rungs 46 making up retention elements, separated by openings 47. Each of the rods 35' is controlled by a cursor 48 provided on the side of the game grid. The cursors 48 extend on either side of the grid 1 and they are guided in oblong slots 48' that delineate their travel.

Given the particular ladder shape of the rods 35', the travel of the cursors 48 is limited to half the width of a chute 3.

In FIG. 16, the flexible rod 35' of the upper section of the grid is positioned so that game pieces 4 can be inserted in the grooves 3 and the rod 35' of the lower section of the grid blocks the bottom of the chutes.

The grid 1 can be locked in vertical position using toes 49 integral with the cursors 48, that can be placed between sets of stops 50 provided on the internal face of the vertical stanchions 6.

When both sliding rods 35' are in blocking position of the corresponding end of the chutes 3, the game grid 1 can pivot freely about its articulation axis 8. The grid can be locked in vertical position by one of the toes 49, when the corresponding cursor 48 is controlled so as to open the upper end of the chutes.

What is claimed is:

1. A strategy game using at least two lots of game pieces with each lot being allocated to a player, the game comprising:

a game grid forming rows and columns, and having a juxtaposition of parallel chutes;

the parallel chutes including a first end and a second end;

at least one of the first and second ends being adapted receive the game pieces;

at least one of the first and second ends being adapted to be blocked so as to prevent the game pieces from falling out;

the game grid being movable between at least a position wherein a first end is substantially disposed above the second end and at least a position wherein a second end is substantially disposed above the first end, wherein the game pieces are visible when disposed within the game grid.

2. The game of claim 1, wherein the game grid comprises at least two ends which are adapted to receive the game pieces.

3. The game of claim 1, wherein the game grid comprises at least two ends which are adapted to be blocked.

4. The game of claim 1, wherein each of the first and second ends of parallel chutes is adapted to receive the game pieces.

5. The game of claim 1, wherein each the first and second ends of the parallel chutes is adapted to be blocked.

6. The game of claim 1, wherein the game grid is configureable so that the first end of parallel chutes receive the game pieces, while the second end of the parallel chutes are blocked.

7. The game of claim 1, wherein the game grid is configureable so that the second end of parallel chutes receive the game pieces, while the first end of the parallel chutes are blocked.

8. The game of claim 1, wherein the game grid is adapted to be arranged in a substantially vertical plane.

9. The game of claim 1, further comprising a frame for supporting the game grid.

10. The game of claim 9, wherein the game grid is rotatably mounted to the frame.

11. The game of claim 9, wherein the game grid is one of pivotally and rotatably the frame about a horizontal axis.

12. The game of claim 11, wherein the game grid is rotatable or pivotal by 180°.

13. The game of claim 9, further comprising a mechanism for locking the game grid with respect to the frame.

14. The game of claim 9, wherein the frame comprises two vertical stanchions and wherein each stanchion is arranged to be disposed along a side of the game grid.

15. The game of claim 14, further comprising an articulation disposed between each stanchion and side of the game grid.

16. The game of claim 14, wherein each side of the game grid is pivotally mounted to a corresponding stanchion.

17. The game of claim 14, wherein at least one of the stanchions comprises a mechanism adapted to cooperate with a mechanism disposed on the game grid, the mechanisms being adapted to lock the game grid in a vertical position.

18. The game of claim 17, wherein the mechanism disposed on the game grid comprises at least one protruding toe.

19. The game of claim 18, wherein the mechanism disposed on the stanchion comprises one of a snap-on system and a groove having contraction zones.

20. The game of claim 14, wherein each side of the game grid comprises at least one protruding toe.

21. The game of claim 20, wherein each of the stanchions comprises one of a snap-on system and a groove having contraction zones adapted to engage a corresponding protruding toe.

22. The game of claim 1, further comprising at least one blocking mechanism for blocking one of the first and second ends in order to prevent the game pieces from falling out.

23. The game of claim 22, wherein the at least one blocking mechanism comprises first and second blocking mechanisms for blocking the respective first and second ends.

24. The game of claim 22, wherein the at least one blocking mechanism is movable between a blocking position which prevents the game pieces from falling out and an un-blocking position which allows the game pieces to fall out.

25. The game of claim 1, wherein the game grid is adapted to be locked in at least one position.

26. The game of claim 25, wherein the game grid is adapted to be locked in two positions.

27. The game of claim 1, further comprising at least one blocking mechanism for blocking one of the first and second ends in order to prevent the game pieces from falling out, the at least one blocking mechanism being disposed adjacent an edge of the first or second ends.

28. The game of claim 27, wherein the blocking mechanism comprises a retention element adapted to slide in an internal groove of the game grid.

29. The game of claim 28, wherein the retention element comprises a control cursor which is adapted to be moved between at least a closed position and an opened position.

30. The game of claim 29, wherein the control cursor is accessible by a player in order to move the retention element.

31. The game of claim 27, wherein the at least one blocking mechanism is slidably disposed within the game grid and wherein the at least one blocking mechanism comprises at least one cursor, plurality of openings, and a plurality of rungs.

32. The game of claim 27, wherein the at least one blocking mechanism is slidably disposed within the game grid and wherein the at least one blocking mechanism comprises at least one cursor and a flexible rod.

33. The game of claim 1, wherein the game grid further comprises at least one blocking mechanism and at least one protruding toe, and wherein the toe is movably connected to a cursor.

34. The game of claim 33, further comprising a frame with two vertical stanchions, wherein the game grid is configured such that movement of the cursor also controls movement of the at least one blocking mechanism, and such that the toe co-operates with a stop disposed on a vertical stanchion of a frame for locking the game grid in a vertical position.

35. A method of playing a game comprising at least two lots of game pieces, each lot being allocated to a player, a game grid forming rows and columns, and having a juxtaposition of parallel chutes, the parallel chutes having a first end and a second end, at least one of the first and second ends being adapted receive the game pieces, at least one of the first and second ends being adapted to be blocked so as to prevent the game pieces from falling out, the game grid being movable between at least a position wherein a first end is substantially disposed above the second end and at least a position wherein a second end is substantially disposed above the first end, wherein the game pieces are visible when disposed within the game grid, the method comprising:

placing the game pieces in the game grid;

moving the game grid to a first substantially vertical position wherein the first end is disposed above the second end;

moving the game grid to a second substantially vertical position wherein the second end is disposed above the first end; and blocking at least one of the first and the second end.

* * * * *